United States Patent [19]

Crow et al.

[11] 4,375,928

[45] Mar. 8, 1983

[54] FLEXIBLE CONCRETE FOR SOIL EROSION PREVENTION

[76] Inventors: Robert Q. Crow; David H. Hansen, both of Ridgetown, Ontario, Canada, N0P 2C0

[21] Appl. No.: 177,849

[22] Filed: Aug. 14, 1980

[51] Int. Cl.[3] ..... E02B 3/12

[52] U.S. Cl. ..... 405/20; 405/17

[58] Field of Search ..... 405/19, 15, 20, 28, 405/16, 29, 17, 18, 30–35; 404/35; 52/606

[56] References Cited

U.S. PATENT DOCUMENTS

| | | | |
|---|---|---|---|
| 869,566 | 10/1907 | Hawkes | 405/20 |
| 1,071,091 | 8/1913 | Rogers | 405/20 |
| 1,772,821 | 8/1930 | Weber | 405/20 |
| 1,939,417 | 12/1933 | Schulz | 405/20 |
| 2,674,856 | 4/1954 | Louckes | 405/20 |
| 3,386,252 | 6/1968 | Nelson | 405/20 |
| 3,597,928 | 8/1971 | Pilaar | 405/20 |
| 4,227,829 | 10/1980 | Landrq | 405/20 |

*Primary Examiner*—Dennis L. Taylor

*Attorney, Agent, or Firm*—Charles Krassov

[57] ABSTRACT

This invention consists of a flexible type of concrete guard against the erosion of soil by flowing waters and wave action. It consists of rows of comparatively small, identical concrete blocks which form rectangular sections which are placed upon the ground surface which has previously been covered with a filter cloth. The said blocks are held together by a continuous wire cable which is embedded centrally in each block, and which passes through each row of blocks, forming a small loop as it leaves one of said rows to enter its next adjacent row, by means of which one section can be joined with the other, and pinned to the ground.

1 Claim, 4 Drawing Figures

FLEXIBLE CONCRETE FOR SOIL EROSION PREVENTION

This invention relates generally to devices used for the protection against erosion of various types of soils which are located adjacent to flowing waters or which are exposed to wave action or heavy rains, and particularly to concrete coverings for such soils.

The most effective soil covering is concrete, because of its high tensile and compression strength and its almost endless resistance to the action of natural types of water. However, contrary to the rigid nature of concrete, such erosion protective coverings must be flexible in order to conform with the contour of the soil; it must prevent the soil from being disolved and carried away by rapidly moving waters; and it must not interfere with the natural growth of vegetation, such as grass, etc., whose roots provide a natural binder to the soil particles.

The above mentioned requirements are accomplished by providing a concrete covering which is flexible, and which, in combination with a permeable filtering cloth, meets the above requirements.

Figure 1:
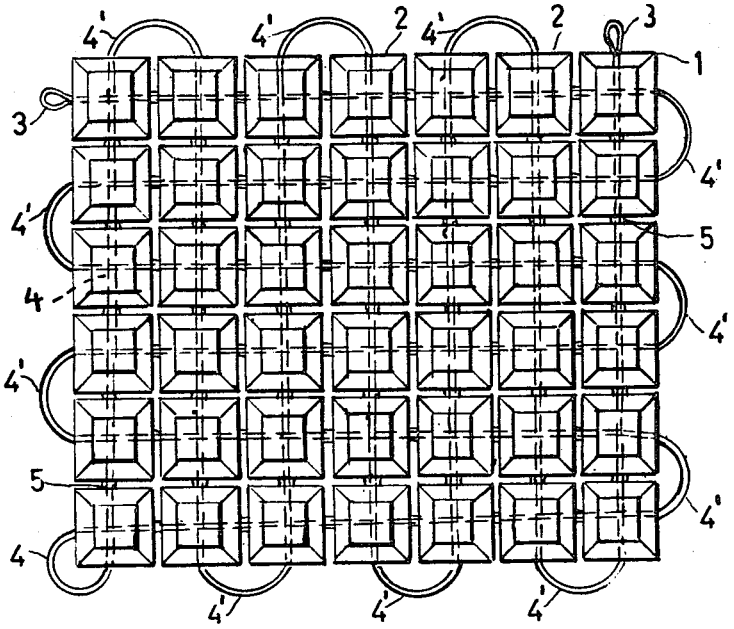
Figure 2:
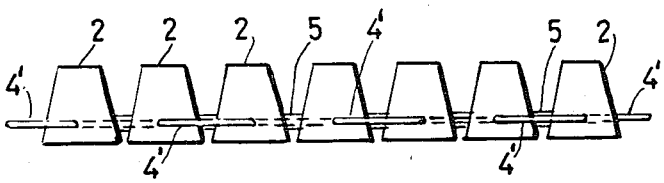
Figure 4:
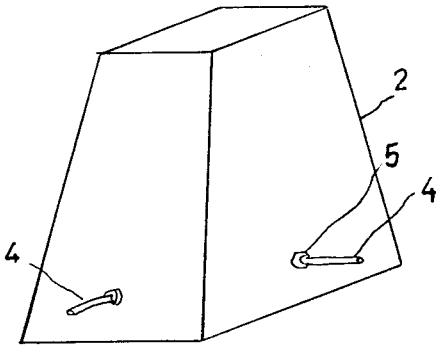
Figure 3:
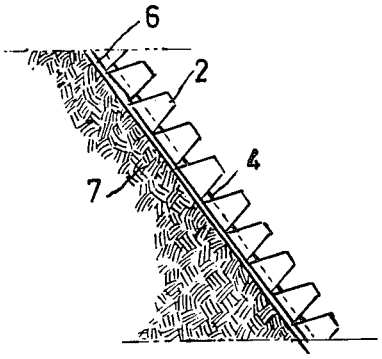

In describing the invention, reference will be made to the attached drawings in which, FIG. 1, shows a plan of a single section of the concrete covering, FIG. 2, is an end view of the covering shown in FIG. 1, FIG. 3, shows a diagram of the covering installed on the ground, and FIG. 4, shows an isometric view of one of the concrete blocks which constitutes one of the components of the invention.

In the drawings the invention is shown consisting of a single section 1, which may be square or rectangular in shape, so that to cover a required area, these sections are laid side by side, abutting each other to form one continuous cover.

Each section is made up of spaced, identical, concrete blocks 2, in the shape of a truncated pyramid having a flat rectangular base and top. The blocks 2 are placed parallel to each other, and with a narrow space between them. The blocks 2 are attached flexibly to each other by a cable 4, which starts with a small loop 3 and passes through each of the blocks, continuously, slightly above the base of the said blocks, running along the block's two crossing centerlines, and running in and out of each row of clocks to form a plurality of loops 4' all around each of the sections 1. These loops also serve as a means for pinning the sections to the ground where it is necessary to do so.

Of course, originally the cable which is preferably made of metal, which has been rust proofed is inserted in the proper location in the form in which the said blocks are cast, so that the cable 4 is permanently embedded in the blocks 2.

During the casting of the blocks, some of the liquid concrete mixture escapes through the holes housing the said cable, forming a rigid but easily broken bond 5 between the blocks. This is an important factor in the construction of each section 1, because during the installation of said sections, they are considerably easier to handle and lift with hoist or crane hooks, when the sections ae rigid, and the bonds 5 are easily broken manually when required to conform with the contour of the terrain 7.

The actual installation of the flexible concrete consists of first covering the terrain with filter cloth 6, sometimes referred to as geotextiles, this allows moisture which enters the ground, from the erosive water or rains to return; it also allows a certain amount of air breathing; and it allows the passage of vegetation therethrough; while at the same time preventing the loss of soil particles from being carried away by the moving water. In the next step, the sections of concrete are laid on top of the filter cloth, to form one continuous protective cover.

The use of this invention provides many advantages which may be listed as follows:

(a) Other products on the market used for the same purpose as the invention have the blocks attached to a cloth background by means of glue. In view of the continuous beating, and soaking for very long periods of time, glue of any kind cannot be expected to retain the bond, as compared to the blocks being tied by non-corrosive metal cables, and because of the longevity of the sections in this invention, the complete cover can easily be relocated.

(b) Because of its rigidity while handling and its flexibility when covering the ground, an area can be covered very rapidly, with a considerable saving in labor costs.

(c) It provides anchorage facilities on all four sides, making it a more stable and more desirable installation.

This invention has been used in a variety of installations, such as river, and creek beds, and banks, on marshes and much areas, and on road beds, with considerable success, and at a great reduction in the cost of installation and relocation, because of its particular construction, as described above, it can be hooked on by the crane hooks on any one of its sides.

Having described our invention what we claim is:

1. A device for the prevention of soil erosion caused by the action of flowing waters, wave action, heavy rains, and floods, comprising, in combination, flexible rectangular concrete sections for covering said soil; said sections consisting of parallel rows of spaced, identical rows of concrete blocks; each of said blocks having the shape of a truncated pyramid having a rectangular base, and a flat top which is parallel to said base; said blocks being fastened to each other by means of a continuous cable made of plastic or a non-corrosive metal which passes through the centers of each block and is embedded therein; said cable providing a small loop at the exit and entrance of each section, for the purpose of handling the said sections by means of hooks or hoists during transportation and installation, and forming a somewhat larger loop as the cable leaves one row of blocks to enter its next adjacent row; and thin concrete bonds between blocks covering the open cable in spaces between said blocks, to provide sufficient rigidity to each of said sections for easy handling during installation, but said concrete bonds being easily broken to provide the required flexibility fo fit and cover the contour of the soil, manually.

* * * * *